US006375519B1

(12) United States Patent
Liang

(10) Patent No.: US 6,375,519 B1
(45) Date of Patent: Apr. 23, 2002

(54) ELECTRIC COUPLER FOR BATTERY OF VEHICLE OR THE LIKE

(76) Inventor: Shih Tsung Liang, P.O. Box 10-69, Chong Ho, Taipei 235 (TW)

( * ) Notice: Subject to any disclaimer, the term of this patent is extended or adjusted under 35 U.S.C. 154(b) by 0 days.

(21) Appl. No.: 09/876,871

(22) Filed: Jun. 8, 2001

(51) Int. Cl.[7] ..... H01R 4/42
(52) U.S. Cl. ..... 439/762; 439/756; 439/754
(58) Field of Search ..... 439/762, 756, 439/755, 754, 367, 522, 521

(56) References Cited

U.S. PATENT DOCUMENTS 2,341,748 A * 2/1944 Webb ..... 439/756
4,042,759 A * 8/1977 Cella ..... 439/754
5,833,499 A * 11/1998 Gonzales et al. ..... 439/522

* cited by examiner

*Primary Examiner*—Tho D. Ta

(57) ABSTRACT

An electric coupler for attaching onto an electrode of a vehicle battery includes a coupler member having a ring extended from one end for receiving the electrode, and a plate extended from the coupler member and located above the ring for forming a gap between the plate and the ring and for shielding the electrode. The plate may be engaged onto and electrically coupled to the electrode. The plate includes one or more apertures for securing the other electric wires and for allowing the other electric facilities to be easily coupled to the electrode.

2 Claims, 4 Drawing Sheets

ELECTRIC COUPLER FOR BATTERY OF VEHICLE OR THE LIKE

BACKGROUND OF THE INVENTION

1. Field of the Invention

The present invention relates to an electric coupler, and more particularly to an electric coupler for coupling to the batteries of the vehicles or the like.

2. Description of the Prior Art

One of the most typical or conventional electric couplers is shown in FIG. 1 and comprise a coupler body 10 secured to an electric wire 2 or the like, and including a ring 11 extended from one end thereof for engaging onto the electrode 21 of the battery of the vehicle or the like. The ring 11 includes an orifice 13 formed in a leg 17 thereof for receiving one end of a fastener 14, and includes a screw hole 12 formed therein and close to the coupler body 10 for threading with the fastener 14 and for securing the ring 11 onto the electrode 21 of the battery. The electric coupler may not shield the electrode 21 of the battery, such that the electrode 21 of the battery will be exposed. In addition, the battery of the vehicle may not be easily coupled to the other electric facilities.

The present invention has arisen to mitigate and/or obviate the afore-described disadvantages of the conventional electric couplers for batteries of vehicles.

SUMMARY OF THE INVENTION

The primary objective of the present invention is to provide an electric coupler for easily and quickly and solidly coupling to the batteries of the vehicles or the like.

The other objective of the present invention is to provide an electric coupler for shielding the electrodes of the batteries of the vehicles or the like.

The further objective of the present invention is to provide an electric coupler for easily coupling the batteries of the vehicles or the like to the other electric facilities.

In accordance with one aspect of the invention, there is provided an electric coupler for attaching onto an electrode, the electric coupler comprising a coupler body including a first end, a ring extended from the first end of the coupler and including a bore formed therein for receiving the electrode, and a plate extended from the coupler body and located above the ring for forming a gap between the plate and the ring and for shielding the electrode. The plate and the ring and the coupler body are made of metal or electric conductive materials. The plate may be engaged onto the electrode of the battery for further electrically coupling to the electrode of the battery.

The plate includes at least one aperture formed therein for attaching an electric wire thereto and for allowing the other electric facilities to be easily and quickly coupled to the electrode of the battery via the plate.

The coupler body and the ring include an oblique slot formed therebetween, for forming a leg in the ring, the slot is inclined relative to a longitudinal axis of the coupler body, for allowing the leg of the ring to be easily and solidly secured to the coupler body, and for allowing the ring to be solidly secured onto the electrode of the battery, particularly of the battery of the vehicle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
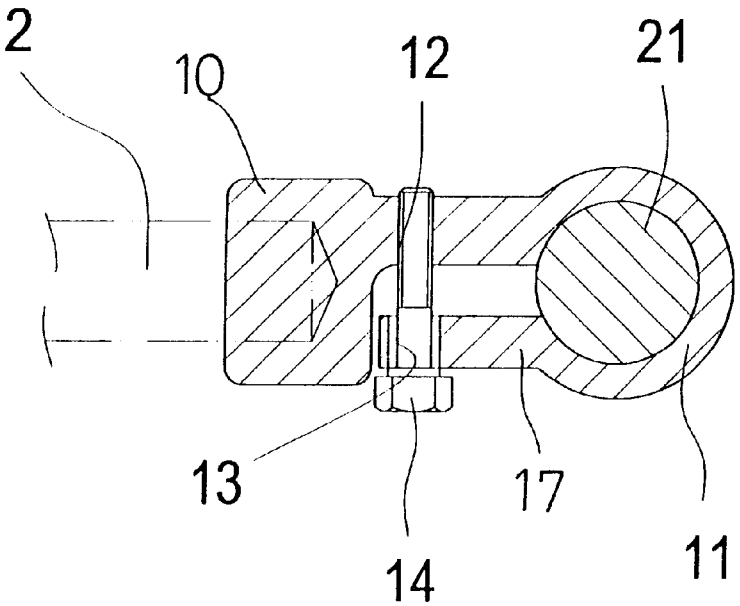
FIG. 1 PRIOR ART
FIG. 1 is a cross sectional view showing a typical electric coupler for coupling to the battery of the vehicle.
Figure 2:
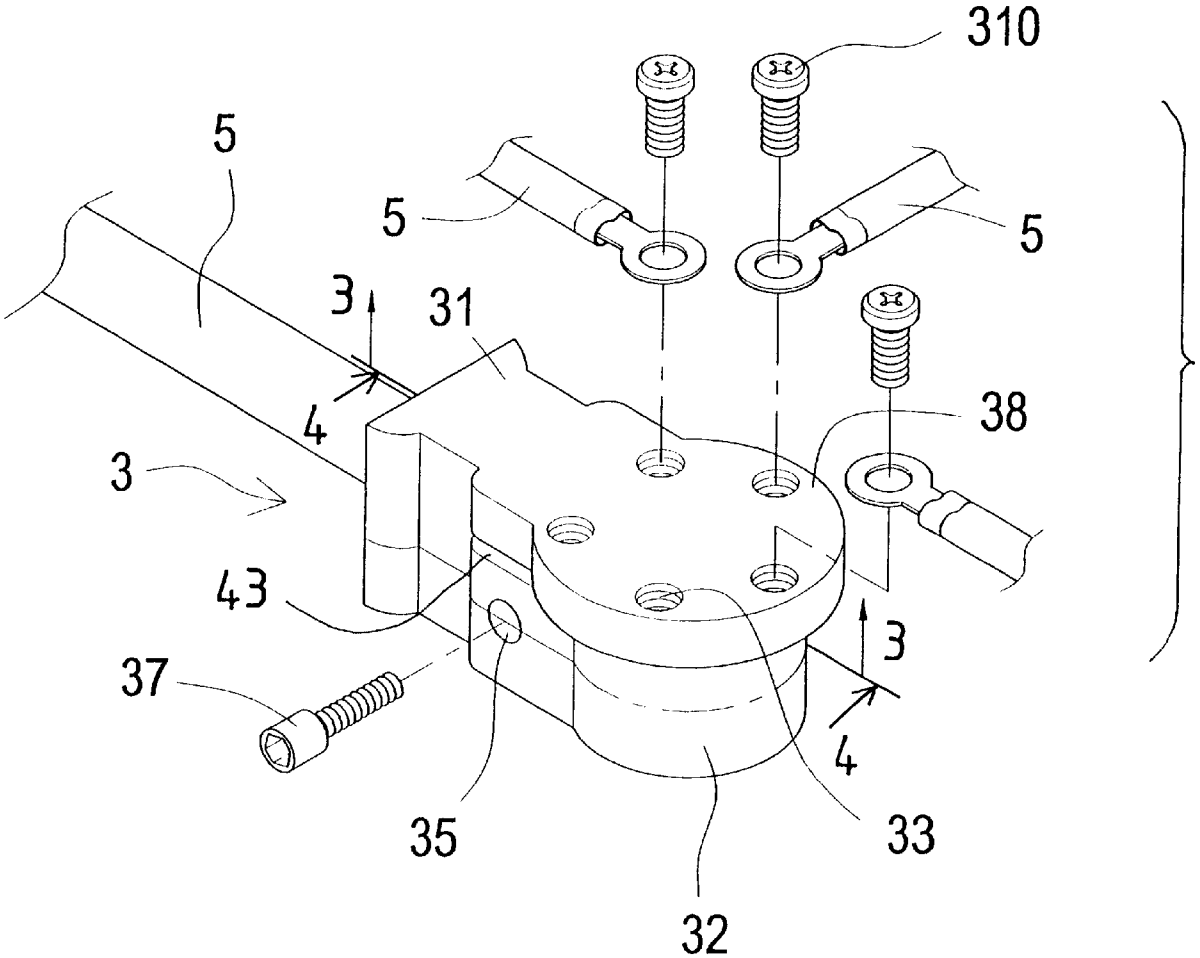
FIG. 2 is an exploded view of an electric coupler in accordance with the present invention.
Figure 4:
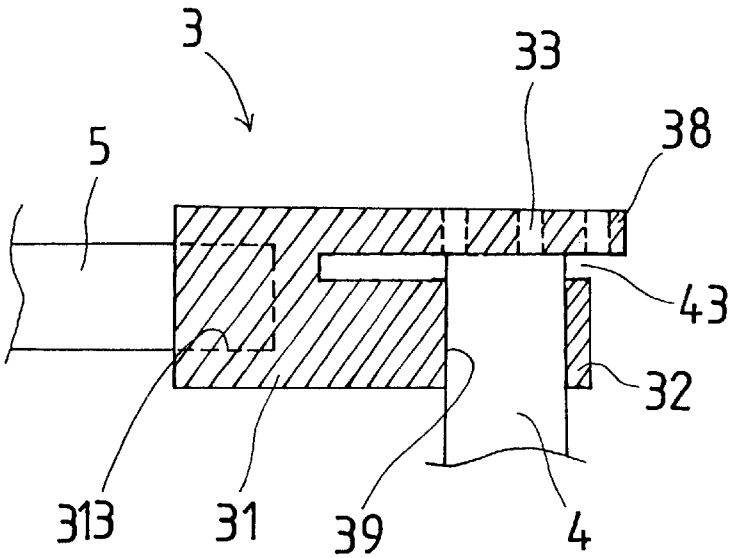
FIGS. 3 and 4 are cross sectional views taken along lines 3—3 and 4—4 of FIG. 2 respectively.
Figure 3:
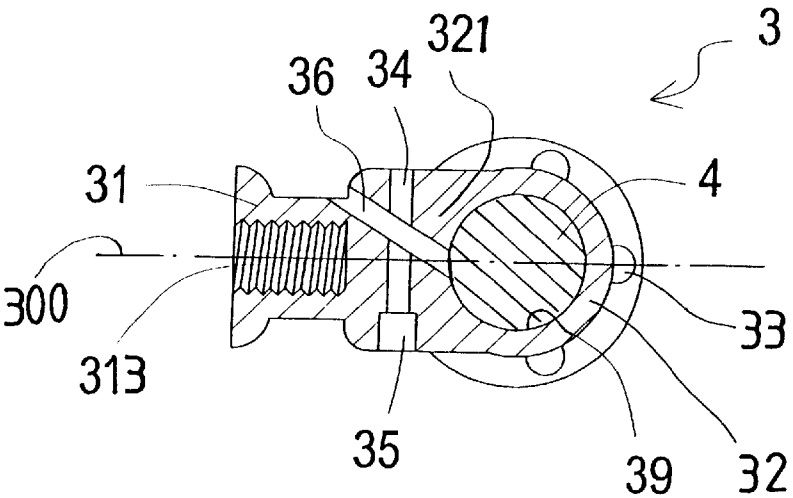

Referring to the drawings, and initially to FIGS. 2–4, an electric coupler 3 in accordance with the present invention comprises a coupler body 31 including a hole, such as a screw hole 313 formed therein for receiving and securing to one end of an electric wire or electric cable 5, and including a ring 32 attached to one end of the coupler body 31, and including an orifice 35 formed therein and located between the coupler body 31 and the ring 32 for receiving one end of the fastener 37 or the like. The ring 32 includes a bore 39 formed therein for receiving the electrode 4 of the typical battery of the vehicle or the like and for engaging or securing onto the electrode 4 of the battery. The electric coupler 3 includes an oblique slot 36 is formed therein, such as formed between the coupler body 31 and the ring 32, and inclined relative to the longitudinal axis 300 of the electric coupler 3 (FIG. 3), and communicating with the bore 39 of the ring 32 for forming a free end or a leg 321 of the ring 32. The leg 321 of the ring 32 includes a screw hole 34 formed therein for threading with the fastener 37 and for securing the ring 32 to the electrode 4 of the battery.

The electric coupler 3 further includes a plate 38 extended therefrom, and preferably located above the ring 32, for engaging onto or for shielding the electrode 4 of the battery (FIG. 4). The plate 38 and the ring 32 and the coupler body 31 are made of metal or conductive materials. It is preferable that the plate 38 is engaged with or contacted with the electrode 4 for further electrically coupling to the electrode 4. A gap 43 is formed between ring 32 and the plate 38, such that the plate 38 will not affect the securing or the attaching of the ring 32 onto the electrode 4. The plate 38 includes one or more apertures or screw holes 33 formed therein, for threading with the fasteners 310 which may secure the other electric wires or cables 5 to the plate 38 and thus to the electrode 4 of the battery. The other electric facilities may thus be easily and quickly secured to or coupled to the electrode 4 of the battery with the electric cables 5.

Figure 5:
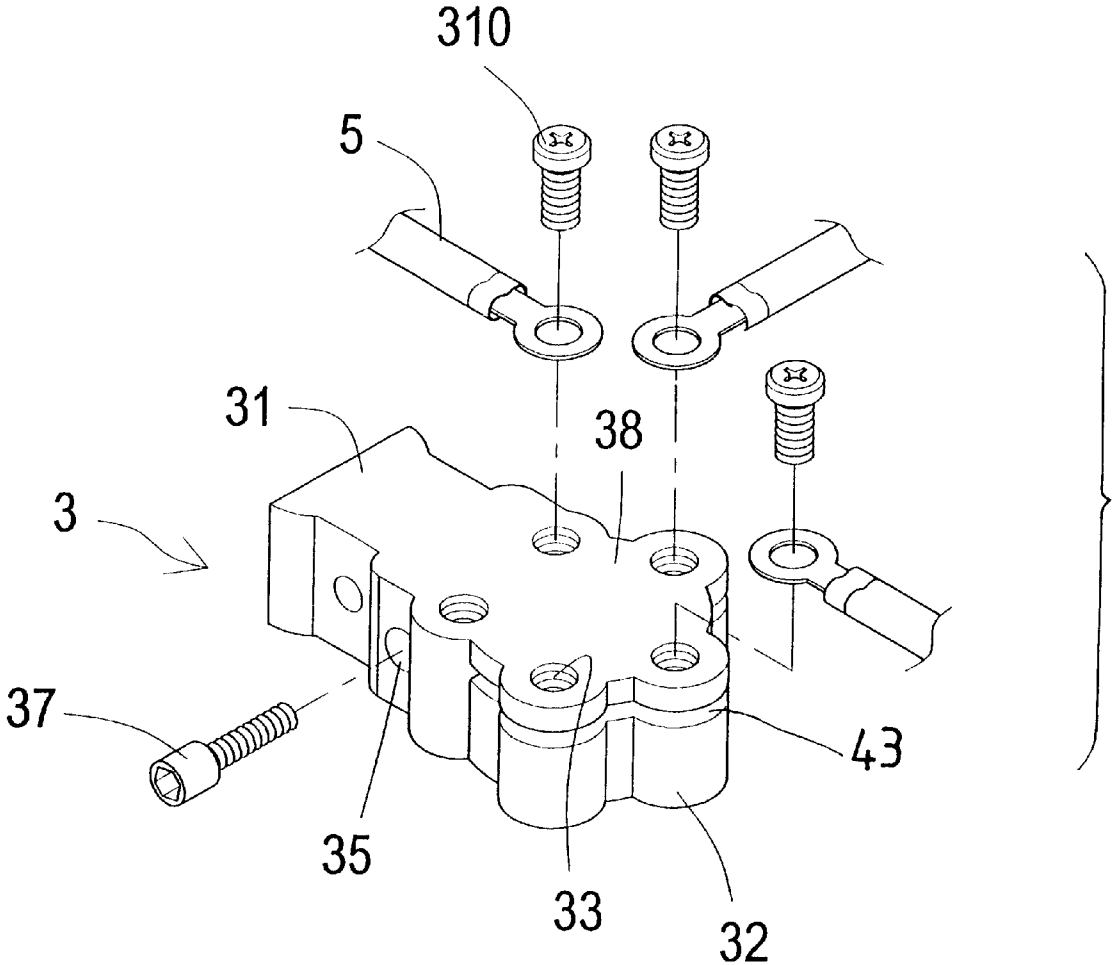
FIG. 5 is an exploded view similar to FIG. 2, illustrating the other embodiment of the electric coupler.

Referring next to FIG. 5, the ring 32 and/or the plate 38 may be formed into various kinds of shapes, for decorative purposes, or for allowing the electric coupler 3 to be easily molded or forged or machined or manufactured. The provision or the formation of the oblique slot 36 between the coupler body 31 and the ring 32 allows the electric coupler 3 to be easily removed from the mold device, for example.

Accordingly, the electric coupler in accordance with the present invention may be used for easily and quickly and solidly coupling to the batteries of the vehicles or the like, and may be used for shielding the electrodes of the batteries of the vehicles or the like, and may be used for easily coupling the batteries of the vehicles or the like to the other electric facilities.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electric coupler for attaching onto an electrode, said electric coupler comprising:

a coupler body including a first end, a ring extended from said first end of said coupler and including a bore formed therein for receiving the electrode, and a plate extended from said coupler body and located above said ring for forming a gap between said plate and said ring and for shielding the electrode, said plate including at least one aperture formed therein for attaching an electric wire thereto.

2. An electric coupler for attaching onto an electrode, said electric coupler comprising:

a coupler body including a first end, a ring extended from said first end of said coupler and including a bore formed therein for receiving the electrode, and a plate extended from said coupler body and located above said ring for forming a gap between said plate and said ring and for shielding the electrode, said coupler body and said ring including an oblique slot formed therebetween, for forming a leg in said ring, said slot being inclined relative to a longitudinal axis of said coupler body.

* * * * *